US011129442B2

(12) United States Patent
Arquilla

(10) Patent No.: US 11,129,442 B2
(45) Date of Patent: Sep. 28, 2021

(54) INSERT LINER FOR FOOTWEAR AND METHOD OF MANUFACTURING THE SAME

(71) Applicant: JCA Investment Holdings Inc., New York, NY (US)

(72) Inventor: Justin Arquilla, Chicago, IL (US)

(73) Assignee: JCA Investment Holdings Inc., Chicago, IL (US)

( * ) Notice: Subject to any disclaimer, the term of this patent is extended or adjusted under 35 U.S.C. 154(b) by 0 days.

(21) Appl. No.: 15/406,140

(22) Filed: Jan. 13, 2017

(65) Prior Publication Data

US 2017/0127760 A1 May 11, 2017

Related U.S. Application Data

(63) Continuation-in-part of application No. 14/040,893, filed on Sep. 30, 2013, now Pat. No. 9,839,259.

(60) Provisional application No. 61/709,087, filed on Oct. 2, 2012.

(51) Int. Cl.

| | |
|---|---|
| ***A43B 3/24*** | (2006.01) |
| ***A43B 13/14*** | (2006.01) |
| ***A43B 23/07*** | (2006.01) |
| ***A43B 1/00*** | (2006.01) |
| ***A43B 17/18*** | (2006.01) |
| ***A43B 19/00*** | (2006.01) |

(52) U.S. Cl.

CPC ..... *A43B 23/07* (2013.01); *A43B 1/009* (2013.01); *A43B 1/0045* (2013.01); *A43B 1/0054* (2013.01); *A43B 1/0081* (2013.01); *A43B 17/18* (2013.01); *A43B 19/00* (2013.01)

(58) Field of Classification Search

CPC ..... A43B 1/0081; A43B 13/226; A43B 23/07; A43B 1/0045; A43B 17/18

See application file for complete search history.

(56) References Cited

U.S. PATENT DOCUMENTS 1,282,584 A * 10/1918 Hunter ..... A43B 23/28 36/58.5
1,803,554 A 5/1931 Knilans
2,154,682 A 11/1934 Johnson
(Continued)

FOREIGN PATENT DOCUMENTS

DE 102006031951 A1 1/2008
EP 1629738 A1 3/2006
(Continued)

*Primary Examiner* — Jila M Mohandesi
(74) *Attorney, Agent, or Firm* — Stinson LLP

(57) ABSTRACT

An insert liner is provided and is configured to be removably received in an inner cavity of a shoe. The elastomeric liner includes: a longitudinal portion; opposing first and second lateral portions; and opposing front and rear portions, wherein the longitudinal, lateral, front, and rear portions define a cavity having an opening configured below the opposing front and rear portions and configured to receive a user's foot; and a fastener coupled to at least the front portion and the rear portion of the liner while being bond free relative to a toe portion of the shoe, the front portion is configured to releasably adhere to the tongue portion to maintain the opening below an upper edge of at least one of the heel portion and the opposing sidewall portions and to define the opening configured to receive the user's foot.

19 Claims, 15 Drawing Sheets

(56) References Cited

U.S. PATENT DOCUMENTS 2,440,563 A * 4/1948 Woyach ..... A43B 3/02 36/7.3
2,537,156 A * 1/1951 Pennell ..... A43B 17/00 36/43
2,584,516 A * 2/1952 Veatch ..... A43B 19/00 36/55
2,798,311 A * 7/1957 Scholl ..... A43B 19/00 36/10
3,063,074 A * 11/1962 Scholl ..... A43B 3/101 12/142 G
3,148,463 A * 9/1964 Tibbitts ..... A41B 11/00 36/44
3,289,329 A * 12/1966 Weiss ..... A41B 11/00 36/10
3,315,276 A * 4/1967 Daxe ..... A41B 11/00 2/239
3,975,929 A * 8/1976 Fregeolle ..... D04B 1/18 602/63
4,169,324 A * 10/1979 Gibbs ..... A43B 17/18 2/239
4,575,954 A * 3/1986 Bye ..... A61F 5/0111 2/240
4,645,466 A 2/1987 Ellis
4,694,590 A 9/1987 Greenawalt
4,813,162 A 3/1989 Harris
5,092,347 A 3/1992 Shaffer et al.
5,154,682 A 10/1992 Kellerman
5,259,126 A * 11/1993 Rosen ..... A43B 23/28 36/55
5,469,641 A * 11/1995 Subotic ..... A43B 5/12 36/71
5,595,005 A 1/1997 Throneburg et al.
5,740,618 A 4/1998 Minden
5,935,671 A * 8/1999 Lhuillier ..... A43B 1/0045 36/10
6,393,734 B1 5/2002 Ou
6,874,253 B2 * 4/2005 Hollis-Lorent ..... A43B 3/0078 36/4
7,007,309 B1 * 3/2006 Mende ..... A41B 11/14 2/239
7,010,872 B2 * 3/2006 Pawlus ..... A43B 3/0047 36/100
7,047,671 B2 5/2006 Steed et al.
7,171,768 B2 2/2007 Klein
7,434,336 B2 * 10/2008 Kosted ..... A43B 1/0081 36/10
7,775,069 B1 * 8/2010 Hermanson ..... D04B 1/265 66/186
3,056,149 A1 11/2011 Duclos
8,181,363 B2 5/2012 Klein
8,424,117 B2 4/2013 Hasan et al.
8,603,019 B1 * 12/2013 Hermanson ..... D04B 1/265 602/60
9,392,836 B2 7/2016 Hatfield et al.
2001/0022096 A1 * 9/2001 Orima ..... D02G 3/12 66/170
2002/0066209 A1 6/2002 Steed et al.
2003/0224685 A1 * 12/2003 Sharma ..... A41D 13/1281 442/304
2004/0058102 A1 * 3/2004 Baychar ..... A43B 23/022 428/34.1
2005/0011083 A1 * 1/2005 Kosted ..... A43B 1/0081 36/9 R
2006/0021252 A1 2/2006 Throneburg et al.
2006/0177645 A1 8/2006 Baychar
2006/0277797 A1 12/2006 McLinden
2007/0141940 A1 * 6/2007 Baychar ..... A41D 31/102 442/328
2007/0271819 A1 * 11/2007 Chen ..... A41B 11/008 36/43
2008/0115385 A1 5/2008 McLinden
2008/0131648 A1 * 6/2008 Baychar ..... B32B 3/26 428/90
2011/0119810 A1 * 5/2011 Diaz ..... A43B 1/0045 2/239
2012/0172821 A1 * 7/2012 McKinney ..... B32B 5/024 604/290
2012/0227281 A1 * 9/2012 Young ..... A43B 19/00 36/10
2012/0304493 A1 12/2012 Hudson et al.
2013/0047313 A1 * 2/2013 Windisch ..... A61F 13/08 2/69

FOREIGN PATENT DOCUMENTS

FR 2807628 A1 10/2001
GB 1124192 A 8/1968
JP 3165725 B2 2/1992
JP 2001503483 A 3/2001
WO 9732498 A1 9/1997

* cited by examiner 100
101
102
105
106
107
108
109
110
111

INSERT LINER FOR FOOTWEAR AND METHOD OF MANUFACTURING THE SAME

CROSS-REFERENCE TO RELATED APPLICATION

This non-provisional application is a continuation-in-part application and claims priority to U.S. Non Provisional patent application Ser. No. 14/040,893, filed on Sep. 30, 2013, which claims priority to U.S. Provisional Patent Application Ser. No. 61/709,087 filed on Oct. 2, 2012, the priority application being hereby incorporated by reference in its entirety.

BACKGROUND

The present disclosure relates to an insert liner for footwear such as a shoe, and more particularly to a semi-permanent, removable insert liner having stretching, wicking and antimicrobial capabilities.

Certain types of shoes are commonly worn without socks, such as casual loafers, sneakers, slip on sneakers, slip on casual shoes, flats, dress shoes, and boat shoes. However, wearing shoes without socks can produce a bad odor from bacteria buildup caused by moisture generated by the user's sweaty feet. Additionally, wearing shoes without socks may cause the user's foot to slip around in the shoe due to moisture buildup. Moreover, the user's foot may uncomfortably stick to the inside of the shoe due to the production of moisture by the user's foot. Further, wearing shoes without socks may cause the user's foot to develop blisters.

Conventional apparatuses may include low-cut socks, such as "loafer socks," and "ankle socks" which may provide the appearance that the user is not wearing socks. However, such conventional low-cut socks may inadvertently slip off the user's foot, such as when the user removes the shoe, or is walking around during every day common use, because the socks do not extend up around the user's ankle. Moreover, such low-cut socks may inconveniently require frequent adjustment by the user to prevent the socks from slipping off the user's lower ankles and heels. Furthermore, conventional low-cut socks may include an additional mechanism for securing the socks to the user's ankles, such as an elastic band. These mechanisms, however, may be uncomfortable or unseemly. Additionally, these mechanisms require the user to locate and dress such low-cut socks each time the user wishes to wear shoes with low-cut socks.

Other conventional solutions may include applying powder to the interior cavity of the shoe to absorb excess moisture from the user's foot. However, applying powder to the interior cavity of the user's shoes may require multiple applications per day, which creates additional expense and increases the user's inconvenience. Additionally, it may be cumbersome or awkward for the user to carry a bottle of powder around such that the powder is readily accessible for multiple reapplications throughout the day.

As a result, there is a need for a semi-permanent, removable insert liner or low-cut sock configured to be detachably adhered to an interior cavity of a shoe such that the user can conveniently slip into user's shoes barefoot, but get to comfortably wear shoes without socks via the insert liner. The insert liner is adhered, fastened, coupled, and/or semi-permanently bonded to the inside of the shoe. It is important to note that in all shoe types worn with the insert liner, wherein the insert liner can be semi-permanently adhered, fastened and/or coupled to the inside of the shoe in a "no show" position. There is a need for an insert liner sock that stays adhered or fastened to the inside of the shoe when the user is finished wearing the shoe, such that when the user slips out of the shoe the insert liner remains fastened inside the shoe. There is also a need for an insert liner or low-cut sock which is configured to be removed from the shoe, machine washed, and subsequently re-adhered to the interior cavity of the shoe until the user desires to wash the insert liner or sock again. There is also a need to provide an odor killing antimicrobial adhesive liner configured to wick moisture away from the user's foot, thereby allowing the user to keep the insert liner inside the shoe for numerous wears without needing to wash the insert liner.

SUMMARY

In one aspect, an insert liner is provided and is configured to be removably received in an inner cavity of a shoe having a heel portion, a toe portion, a tongue portion, an insole portion, and opposing sidewall portions. The elastomeric liner includes: a longitudinal portion; opposing first and second lateral portions extending from opposite sides of the longitudinal portion; and opposing front and rear portions extending from opposite ends of the longitudinal portion, wherein the longitudinal, lateral, front, and rear portions define a cavity having an opening configured below the opposing front and rear portions and configured to receive a user's foot; and a fastener coupled to at least the front portion and the rear portion of the liner while being bond free relative to a toe portion of the shoe, the front portion is configured to releasably adhere to the tongue portion to maintain the opening below an upper edge of at least one of the heel portion and the opposing sidewall portions and to define the opening configured to receive the user's foot such that the bond between front portion and the tongue portion facilitates a counter-pulling force as the user's foot is inserted into the cavity, the fabric layer is configured to stretch around the user's foot to expand the wicking material and the antimicrobial material of the yarns.

In another aspect, an insert liner is provided. The insert liner is configured to be removably received in an inner cavity of a shoe having a heel portion, a toe portion, a tongue portion, an insole portion, and opposing sidewall portions. The insert liner includes an elastomeric liner made of a fabric layer of yarns having a wicking material and an antimicrobial material. The elastomeric liner includes: a longitudinal portion; opposing first and second lateral portions extending from opposite sides of the longitudinal portion; and opposing front and rear portions extending from opposite ends of the longitudinal portion; a retainer coupled to the front portion, wherein the longitudinal, lateral, front, rear portions and the retainer define an opening configured below the opposing front and rear portions and configured to receive a user's foot; and a fastener coupled to at least the longitudinal portion and the rear portion of the liner while being bond free relative to the toe portion and tongue portion of the shoe. The rear portion is configured to releasably adhere to the heel portion, the longitudinal portion is configured to releasably adhere to the insole portion, and the front portion is configured to releasably adhere to the tongue portion to maintain the opening below an upper edge of at least one of the heel portion and the opposing sidewall portions and to define the opening configured to receive the user's foot such that retainer facilitates a counter-pulling force as the user's foot is inserted into the cavity. The fabric layer is configured to stretch around the user's foot to expand the wicking material and the antimicrobial material of the yarns.

BRIEF DESCRIPTION OF THE DRAWINGS

Features aspects, and advantages of the present disclosure will become better understood when the following Detailed Description is read with reference to the accompanying drawings in which like characters represent like parts throughout, wherein.

DETAILED DESCRIPTION

Figure 1A:
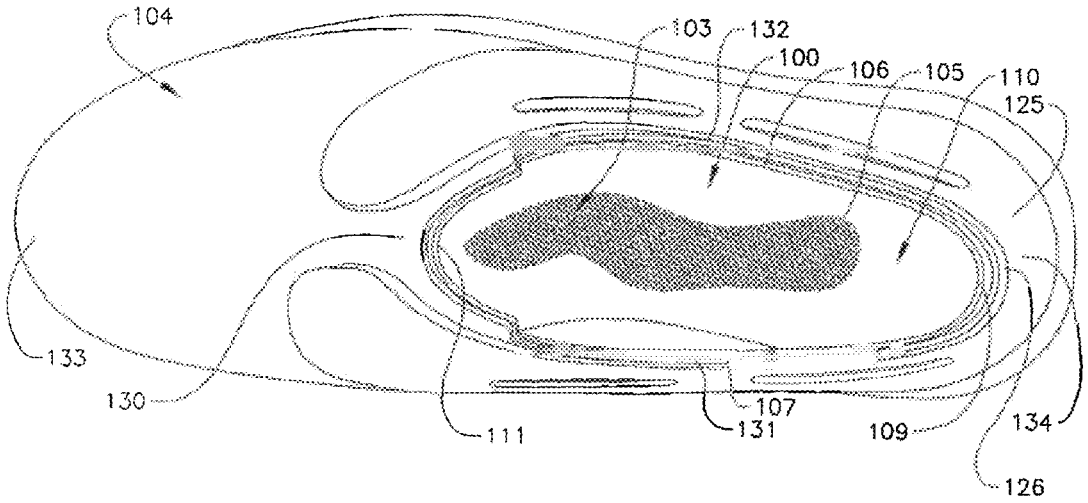
FIG. 1A is a top view of an exemplary insert liner removably coupled via a fastener to an interior cavity of a shoe.

The embodiments described herein are directed to an antimicrobial insert liner which is configured to detachably adhere or removably couple to an interior cavity of a shoe. In the exemplary embodiments, the fastener includes a hook and loop fastener which has respective hooks and loops. Alternatively, any type of fastener can be used to facilitate connecting together the insert liner and the shoe.

In the exemplary embodiments described herein, the insert liner includes a longitudinal portion, opposing first and second lateral portions extending in a first direction from opposite sides of the longitudinal portion, and opposing front and rear portions extending in the first direction from opposite ends of the longitudinal portion. Together, the longitudinal, lateral, front, and rear portions of the insert liner define an opening configured to receive a user's foot. The opening that is configured to receive the user's foot may also include a tongue portion that extends from the top of the opening configured to receive the user's foot back towards the rear longitudinal portion of the insert liner. The tongue portion of the insert liner includes the hook or other fastening mechanism that has been permanently hot melted, glued, sewn, ultrasonically welded, and/or knit into or onto the insert liner such that the hook can be removably coupled to the congruent piece of loop that is adhered, preferably by an adhesive, to the tongue portion of the shoe.

The fastener is configured to facilitate the ability of the insert liner to create an opening required to receive the user's foot such that the user can slip into the shoe barefoot without challenge or adjustment to the insert liner. For the embodiments described herein, the user continues to slip in and out of the shoe barefoot but realizes and/or experiences the comfort of a thin sock while inside the shoe. The insert liner is configured to fit into any type of shoe, such as, loafers, boat shoes, slip-on shoes, formal work shoes, oxfords, flats or any other shoe typically worn with or without socks as a way of fashion, comfort, convenience, medical or other purposes.

In an embodiment, when the insert liner is releasably fastened to the interior cavity of the shoe, the insert liner is positioned below a collar portion of the shoe to facilitate the "no show" or "no look" appearance. In an embodiment, the insert liner is releasably fastened to at least one of the heel portion, the sidewall portions, the insole portion, and the tongue portion of the shoe. In another embodiment, the insert liner is releasably fastened to the tongue portion of the shoe and the insert liner is not adhered to the toe portion of the shoe such that a front portion of the insert liner is configured to stretch forward toward the toe portion of the shoe when a user's foot is inserted into the insert liner. Still further, in an embodiment, the insert liner is releasably fastened to the heel portion and/or the insole portion, and not releasably fastened to the sidewall portions and/or the tongue portion of the shoe. In an embodiment, when the insert liner is removed from the shoe, the loop remains firmly adhered in the inside of the shoe, and ready to receive the insert liner's hook (bonded to the outside of the insert liner), for the next time the user desires to use the insert liner in the shoes.

Figure 1B:
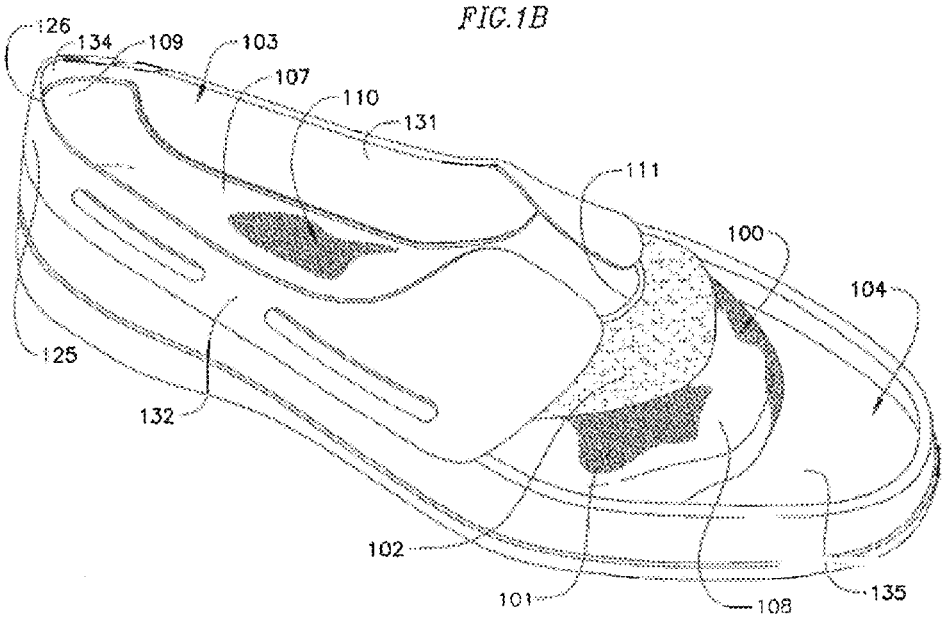
FIG. 1B is a perspective view of the insert liner and the shoe of FIG. 1A, with a tongue portion of the shoe omitted to reveal a toe portion of the insert liner such that the insert liner can wrap around the user's foot and stretch as the user puts his foot in barefoot into the shoe.
Figures 2A, 2B:
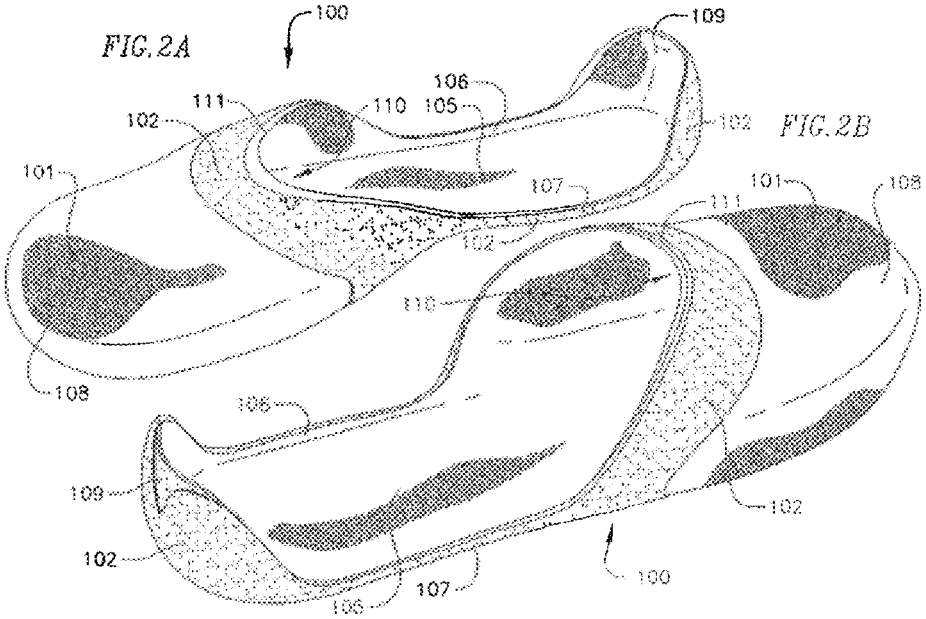
FIGS. 2A and 2B are front and rear perspective views, respectively, of the insert liner of FIG. 1A.
Figure 3A:
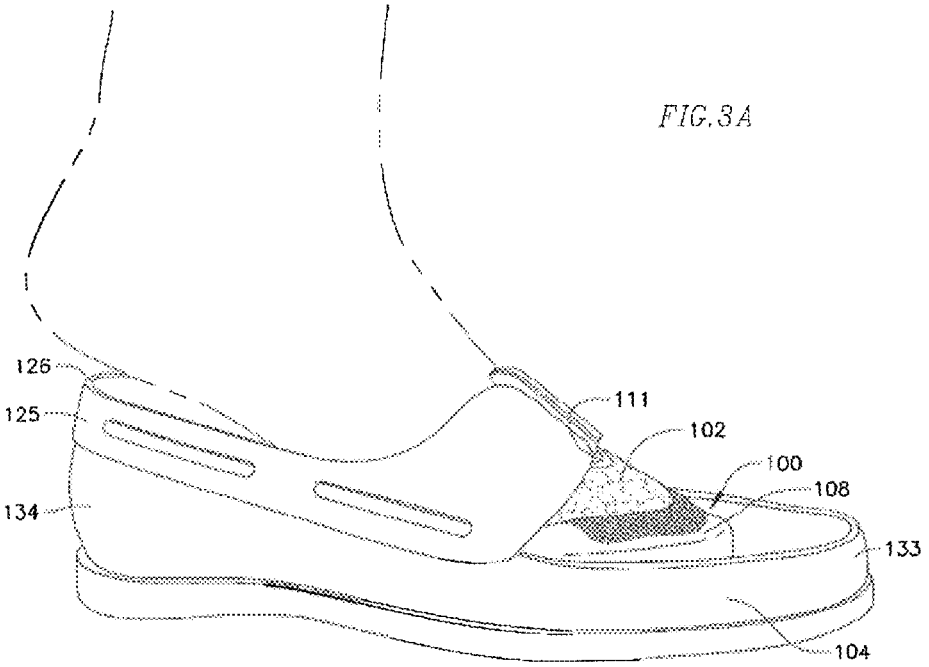
FIG. 3A is a perspective view of a user's foot partially inserted into the insert liner and shoe of FIG. 1B.
Figure 3B:
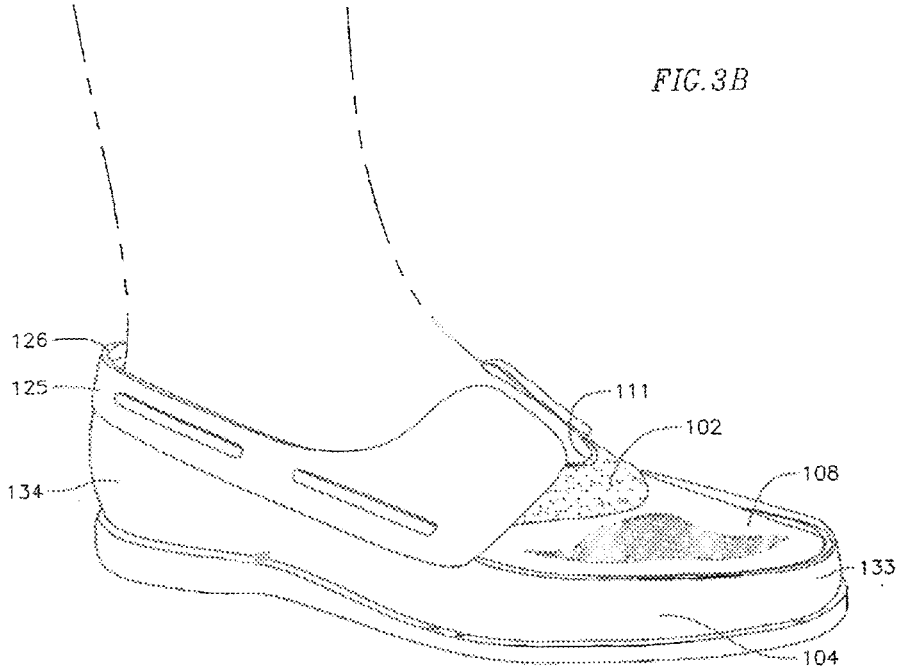
FIG. 3B is a perspective view of a user's foot fully inserted into the insert liner and shoe, illustrating the stretching capabilities of the front portion of the insert liner.

FIG. 1A is a top view of an insert liner 100 removably coupled via a fastener 102 to an interior cavity of a shoe 104. FIG. 1B is a perspective view of the insert liner 100 and the shoe 104 of FIG. 1A, with a tongue portion of the shoe 104 omitted to reveal a toe portion of the insert liner 100 such that the insert liner 100 can wrap around the user's foot and stretch as the user puts his foot in barefoot into the shoe 104. FIGS. 2A and 2B are front and rear perspective views, respectively, of the insert liner 100 of FIG. 1A. FIG. 3A is a perspective view of a user's foot partially inserted into the insert liner 100 and shoe 104 of FIG. 1B. FIG. 3B is a perspective view of a user's foot fully inserted into the insert liner 100 and shoe 104, illustrating the stretching capabilities of the front portion of the insert liner 100.

The insert liner 100 comprises a fabric layer 101 made of yarns and a fastener 102 coupled to, fused, sewn or by other means permanently bonded to at least a portion of an exterior surface of the fabric layer 101. In one embodiment, the insert liner 100 comprises an elastomeric material. In another embodiment, the insert liner 100 comprises a fabric configured to wick moisture away from the user's foot. In an embodiment, approximately 5 to 100 percent of the insert liner 100 includes an antimicrobial material. The insert liner 100 may be comprised of any suitable material. It will be appreciated that the fastener 102 is configured to detachably adhere the insert liner 100 to the interior cavity 103 of a shoe 104, and the fabric layer 101 is configured to wick moisture away from the user's foot and provide comfort to the user as well as eliminate odor causing bacteria via an antimicrobial yarn that is embedded within or on the insert liner 100.

In the exemplary embodiment, the insert liner 100 includes a longitudinal portion 105, opposing lateral portions 106, 107 extending upward from opposite sides of the longitudinal portion 105. Moreover, the insert liner 100 includes opposing front and rear portions 108, 109 extending upward from opposite ends of the longitudinal portion 105. The opposing first and second lateral portions 106, 107 are configured to extend in a first direction from opposite sides of the longitudinal portion 105; and opposing front and rear portions 108, 109 are configured to extend in the first direction from opposite ends of the longitudinal portion 105. Moreover, as measured from the longitudinal portion 105, the opposing first and second lateral portions 106, 107 have a height less than a height of the opposing front and rear portions 108, 109. The sizes and shapes of the portions 105, 106, 017, 108, and 109 are configured to selectively position the insert liner 100 into and out of the shoe 104 and to facilitate the "no show/no look" appearance of the insert liner 100.

As described herein, forward edges of the lateral portions 106, 107 of the insert liner 100 are connected to the front portion 108 by any suitable means, such as stitching or knitting. Similarly, rear edges of the lateral portions 106, 107 of the insert liner 100 are connected to the rear portion 109 by any suitable means, such as stitching or knitting. In one or more alternate embodiments, the insert liner 100 may be made via a sock knitting machine, thereby eliminating the need for any additional stitching. Connecting the lateral portions 106, 107 to the front portion 108 and the rear portion 109 forms a cavity 110 configured to receive the user's foot through an opening 111. More particularly, the longitudinal, lateral, front, and rear portions 105, 106, 107, 108, 109 define the opening 111 configured below the opposing front and rear portions 108, 109 and configured to receive a user's foot.

The insert liner 100 is configured to be received in the interior cavity 103 of the shoe 104. The interior cavity 103 of the shoe 104 includes opposing sidewalls 131, 132, forward toe and tongue portions 133, 130, respectively, a heel portion 134, and a bottom/sole portion 135 extending longitudinally between the toe and heel portions 133, 134 and extending laterally between lower ends of the opposing sidewalls 131, 132. When the insert liner 100 is inserted into the interior cavity 103 of the shoe 104, the longitudinal, lateral, front, and rear portions 105, 106, 107, 108, 109, respectively, of the insert liner 100 are configured to substantially conform to the sole 135, sidewalls 131, 132, tongue 130, and heel portions 134 of the shoe 104, respectively. In an embodiment, the insert liner 100 extends from a furthest upper edge of the tongue portion 130 of the shoe 104 to a region approximately midway between the toe portion 133 and the upper edge of the tongue portion 130 of the shoe 104. In an alternate embodiment, the insert liner 100 may cover the entire portion of the interior cavity 103 extending between the toe portion 133 and the upper edge 20 of the tongue portion 130 of the shoe 104. It will be appreciated, however, that the insert liner 100 may be configured to extend any desired amount between the toe portion 133 and tongue portion 130 of the shoe 104.

As described herein, the fastener 102 may be applied to any desired amount of the fabric layer 101. In the exemplary embodiment, the fastener includes a first portion 136 and a second portion 138. The first portion 136 and the second portion 138 are configured to removably couple to each other. In an embodiment, the first portion 136 includes a male configuration/structure and the second portion 138 includes a female configuration/structure. The male structure is configured to contact and removably couple to the female structure; and, the female structure is configured to receive and removably couple to the male structure. More particularly, the fastener 102 includes a hook and loop fastener wherein the first portion 136 includes a hook 136 and the second portion 138 includes a loop 138. The hook 136 may consist of traditional male hook fasteners, or knitted or woven fabrics which are configured to create a bond with the loop 138. The loop 138 may consist of traditional female loop fasteners, or knitted or woven fabrics which are configured to create a bond with the hook 136. Alternatively, the fastener 102 can include any type of interacting and/or interconnecting portions that can removably couple to each other. For example, in alternative embodiments, the fastener 102 can include adhesives and/or magnetic yarns knitted into or embedded within the insert liner 100 or coupled to or adhered to the shoe 104. The adhesives and/or magnetic yarns can be selectively positioned in and/or on the first portion 136 and the second portion 138 of the fastener 102. The adhesives and/or magnetic yarns are configured to removably couple, adhere, attach to each other to provide a plurality of fastening means to removably couple the insert liner 100 to the shoe 104.

Figure 4:
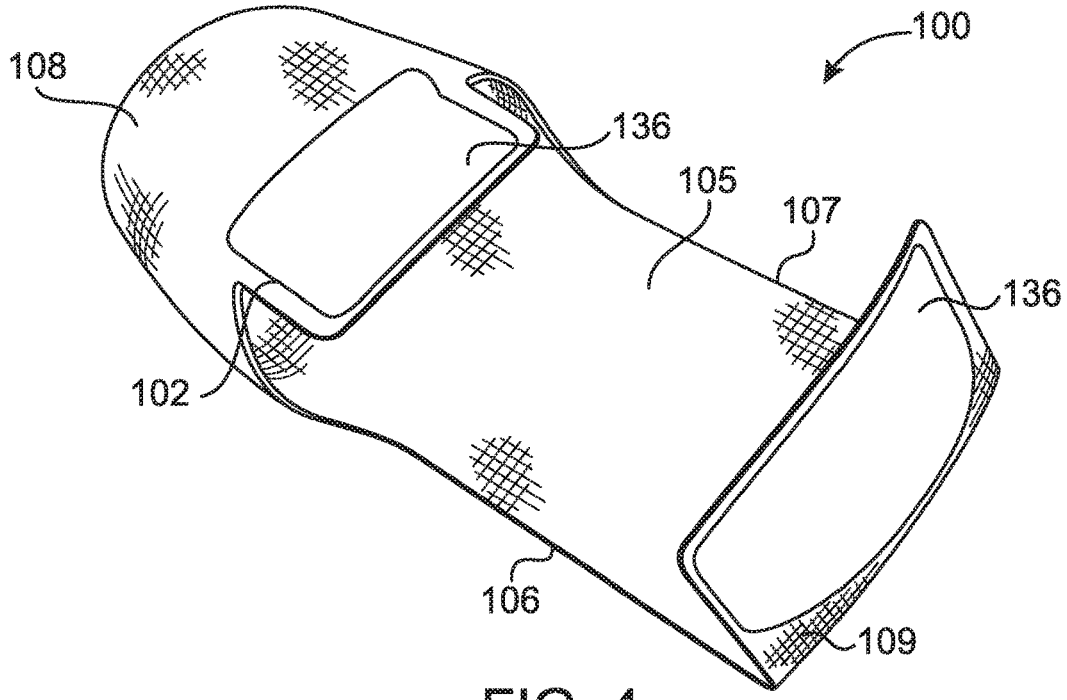
FIG. 4 is a perspective view of the insert liner and the fastener, wherein the fastener include a hook and loop fastener with a hook coupled to the insert liner, and in particular, the hook coupled to a front portion of the insert liner and a rear portion of the insert liner.
Figure 5:
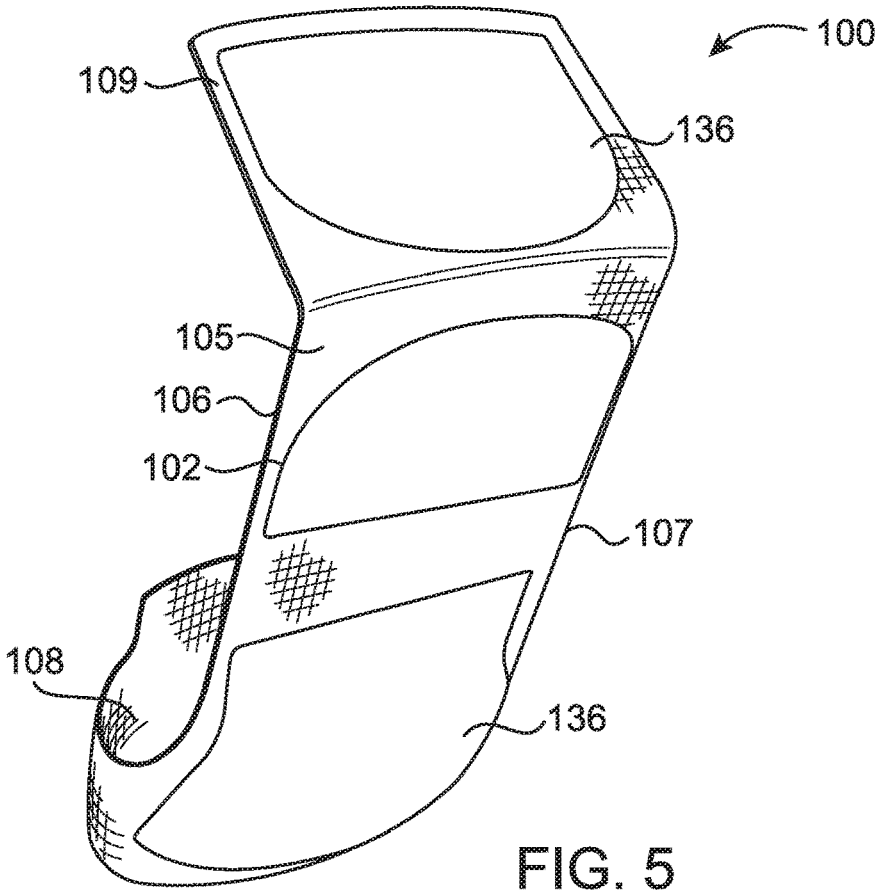
FIG. 5 is a perspective view of the insert liner and the fastener, and in particular, the hook coupled to a longitudinal portion of the insert liner and the rear portion of the insert liner.
Figure 6:
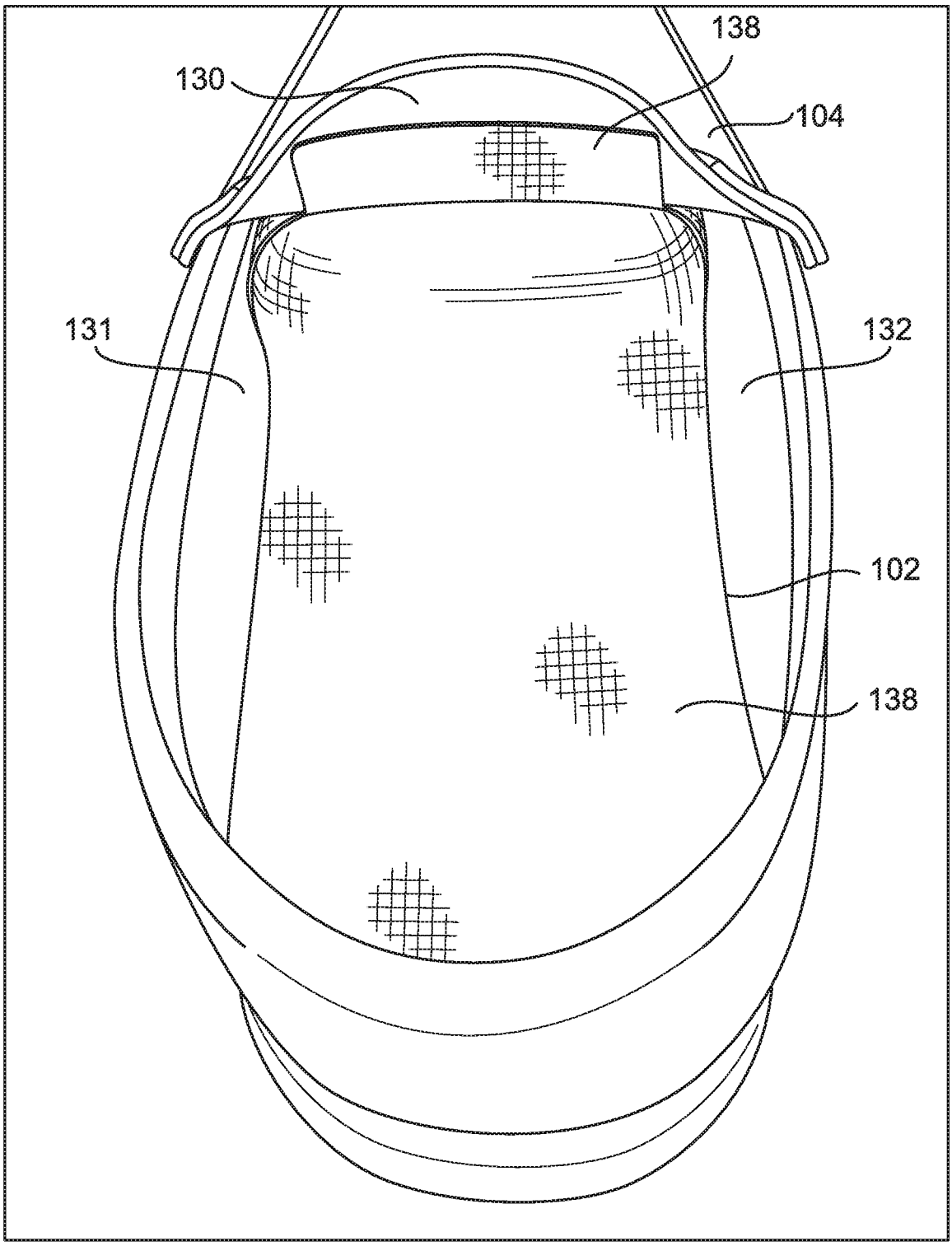
FIG. 6 is a perspective view of the shoe and the fastener which includes a loop coupled to the shoe, and in particular, the loop coupled to a tongue portion of the shoe and coupled to the sole portion of the shoe.
Figure 7:
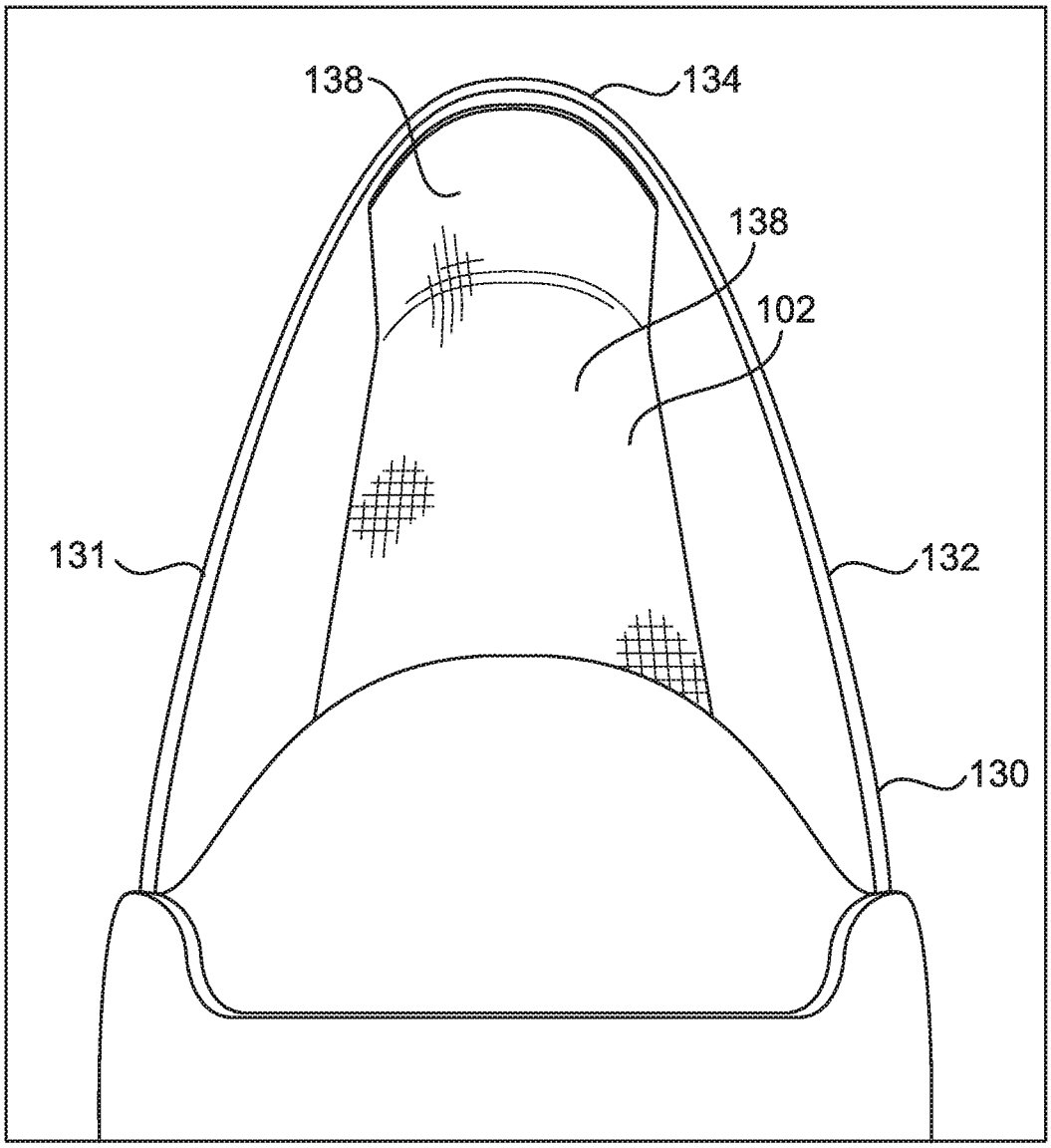
FIG. 7 is a perspective view of the loop coupled to the shoe, and in particular, the loop coupled to a heel portion of the shoed and coupled to the sole portion of the shoe.

FIG. 4 is a perspective view of the insert liner 100 and the fastener, wherein the fastener includes the hook 136 coupled to the insert liner 100, and in particular, the hook 136 coupled to the front portion 108 of the insert liner 100 and the rear portion 109 of the insert liner 100. FIG. 5 is a perspective view of the insert liner 100 and the fastener, and in particular, the hook 136 coupled to the longitudinal portion 105 of the insert liner 100 and the rear portion 109 of the insert liner 100. FIG. 6 is a perspective view of the shoe 104 and the fastener which includes the loop 138 coupled to the shoe 104, and in particular, the loop 138 coupled to the tongue portion 130 of the shoe 104 and coupled to the sole portion 135 of the shoe 104. FIG. 7 is a perspective view of the loop 138 coupled to the shoe 104, and in particular, the loop 138 coupled to the heel portion 134 of the shoe 104 and coupled to the sole portion 135 of the shoe 104. Any suitable portion of the insert liner 100 may include the congruent hook 136 and loop 138 fasteners. In an embodiment, only a portion of the front portion 108 of the insert liner 100 includes the fastener 102.

In an embodiment, the hook 136 is coupled, adhered, fastened, or attached to the insert liner 100 by at least one of a permanent hot melt, a glue, a stitch, an ultrasonically weld, and knitting to at least one of the longitudinal portion 105, the opposing lateral portions 106, 107, the front portion 108, and the rear portion 109 of the insert liner 100. Alternatively, the hook 136 can be coupled to the insert liner 100 by any permanent or semi-permanent attaching means. The hook 136 can include a plurality of hooks 136 selectively positioned and coupled to different portions of the insert liner 100. Alternatively, the hook 136 can include a single continuous piece selectively positioned on/in and coupled to the insert liner 100.

The loop 138 is coupled to the shoe 104 by an adhesive such as, but not limited to, an aggressive yet removable adhesive applied or coated on a back side of the loop 138 such that the loop 138 can be inserted and firmly adhered to at least one inner portion of the shoe 104. The loop 138 can include a plurality of loops 138 selectively positioned on/in and coupled to different portions of the shoe 104. Alternatively, the loop 138 can include a single continuous piece selectively positioned and coupled to the shoe 104. In an embodiment, the loop 138 may include two pieces, one for the bottom heel and one for the mid sole of the shoe 104. In another embodiment, the loop 138 may include on continuous piece from the bottom heel to the tip of the mid sole of the shoe 104.

Upon inserting the insert liner 100 into the shoe 104, the fastening of the hook 136 on the insert liner 100 and the loop 138 adhered to the interior of the shoe 104 allows the insert liner 100 to be semi-permanently fastened in a "no show" or "no look" position to the interior of the shoe 104. The semi-permanent bond may be created with the aforementioned hook and loop fastener 102, a traditional adhesive cured onto the outside of the insert liner 100, or a magnetic field created by magnetic yarns knit into the insert liner 100 and/or into the hook 136 and the loop 138. It is understood that given the sensitivity of sizing with human's feet and shoe 104*s*, the hook 136 and loop 138 or other fastening mechanism of the fastener shall be of the thinnest quality available such that the combination of the insert liner 100 and the fastener 102 do not alter the way the user's shoe 104 fits.

The contact between the hook 136 and the interior cavity 103 of the shoe 104 which contains the congruent loop 138 detachably adheres the insert liner 100 to the shoe 104. In the illustrated embodiment of FIGS. 2A and 2B, the hook 136 is coupled to the longitudinal portion 105, the rear portion 109 and a portion of the front portion 108 of the fabric layer 101. Additionally, the hook 136 can couple to either or both of the opposing lateral portions 106, 107. In the illustrated embodiment, the hook 136 is applied to the portion of the front portion 108 which engages the tongue portion 130 of the shoe 104 when the insert liner 100 is inserted into the interior cavity 103 of the shoe 104. In the illustrated embodiment, the hook 136 102 is not fused to the front portion 108 of the fabric layer 101 which corresponds to the toe portion 133 of the shoe 104. This permits the front portion 108 of the insert liner 100 to stretch forward as the user's foot is inserted into the cavity 110 of the insert liner 100, as illustrated in FIGS. 3A and 3B. That is, the portion of the front portion 108 of the fabric liner 100 corresponding to the toe portion 133 of the shoe 104 may be free of any fastener 102 such that the front portion 108 is configured to function in the same manner as a toe section of a conventional dress sock or no-show sock.

Accordingly, in the embodiments described herein, the front portion 108 of insert liner 100 is spaced apart from the toe portion 133 of the shoe 104 when a user's foot is not inserted into the cavity 110 of the insert liner 100. Then, as the user's foot is inserted into the interior cavity 110 of the insert liner 100, the front portion 108 of the insert liner 100 is configured to stretch forward toward the toe portion 133 of the shoe 104, thereby conforming to the shape of the user's foot thus allowing the fabric layer 101 to grip the user's foot tightly which enhances the wicking and antimicrobial abilities of the yarns. FIG. 3A illustrates a user's foot entering the insert liner 100 with the front portion 108 unstretched; and, FIG. 3B illustrates the front portion of the insert liner 100 stretched around the user's foot when the user's foot is fully inserted into the insert liner 100 and shoe 104.

Additionally, the hook 136 is coupled to the front portion 108 of the insert liner 100 and fastens to the loop 138 adhered, for example, via a pressure sensitive adhesive to the tongue portion 130 of the shoe 104 and thereby maintains the opening 111 in the insert liner 100 such that the user's bare foot may be readily inserted into the cavity 110 of the insert liner 100. Furthermore, the fastening bond between the hook 136 fused to the insert liner 100 and the loop 138 adhered to the tongue portion 130 of the shoe 104 provides a counter-pulling force as the user's foot is inserted into the cavity 110 in the insert liner 100, thereby allowing the front portion 108 of the insert liner 100 to be stretched snuggly around the user's foot (for example, the insert liner 100 is configured to remain fastened to the tongue portion 130 of the shoe 104 as the user's foot is inserted into the cavity 110 of the shoe 104 such that the front portion 108 of the insert liner 100 may stretch toward the toe portion 133 of the shoe 104 and thereby conform to a portion of the user's foot).

In other words, the fastener 102 is coupled or bonded to at least the lateral portion 105, the front portion 108 and the rear portion 109 of the insert liner 100 while being bond free relative to the toe portion of the insert liner 100. The rear portion 109 is configured to releasably adhere to the heel portion 134, the longitudinal portion 105 is configured to releasably adhere to the insole portion 135, and the front portion 108 is configured to releasably adhere to the tongue portion 130 to maintain the opening 111 below an upper edge 126 of at least one of the heel portion 134 and the opposing sidewall portions 131, 132 and to define the cavity 110 configured to receive the user's foot. The bond between front portion 108 and the tongue portion 130 facilitates a counter-pulling force as the user's foot is inserted into the cavity 110. The fabric layer 101 of the insert layer 100 is configured to stretch around the user's foot to expand the wicking material and the antimicrobial material of the yarns of the fabric layer 101.

In an embodiment, between approximately 5% and approximately 100% of the fabric layer 101 comprises an antimicrobial material. It will be appreciated, however, that the proportion of the fabric layer 101 comprising antimicrobial material is not limited to the amounts recited above, and any desired amount of antimicrobial material may be provided depending upon the conditions in which the insert liner 100 will be used. In one embodiment, the fabric layer 101 comprises a material configured to wick moisture away from the user's foot. In another embodiment, the fabric layer 101 comprises an elastomeric material, such as spandex. In a further embodiment, approximately 5% of the fabric layer 101 comprises spandex. It will be appreciated, however, that the fabric layer 101 may be comprised of a greater or lesser proportion of elastomeric material depending upon the desired elasticity of the insert liner 100.

The insert liner 100 can be configured not to extend above a collar portion 125 of the shoe 104 when the insert liner 100 is adhered to the interior cavity 103 of the shoe 104 (for example, the insert liner 100 may be configured to extend slightly below an upper edge 126 of the collar portion 125 of the shoe 104). Recessing the insert liner 100 below the upper edge 126 of the collar portion 125 of the shoe 104 tends to conceal the insert liner 100 from view by other 15 individuals. That is, the insert liner 100 may be configured such that the insert liner 100 is not visible during use. In this way, the insert liner 100 is configured to maintain the desired sockless appearance or a "no show" or "no look" appearance.

The insert liner 100 can be fastened to the interior cavity 103 of the shoe 104 without the aid of an applicator device. In one embodiment, the user may use his or her hand to place the insert liner 100 into the shoe 104 much like a conventional arch support and then supply the pressure necessary to fasten the hook 136 or other fastening mechanism 102 of the insert liner 100 to the interior walls of the shoe 104 portions containing the congruent loop 138 or other receiving mechanisms that are adhered in place to the back side of the loop material. In one embodiment, the user may then insert his or her foot into the cavity 110 of the insert liner 100 and then step into the shoe 104. The user may then move his or her foot in multiple directions to apply the requisite pressure to detachably adhere the insert liner 100 to the shoe 104.

Figure 8:
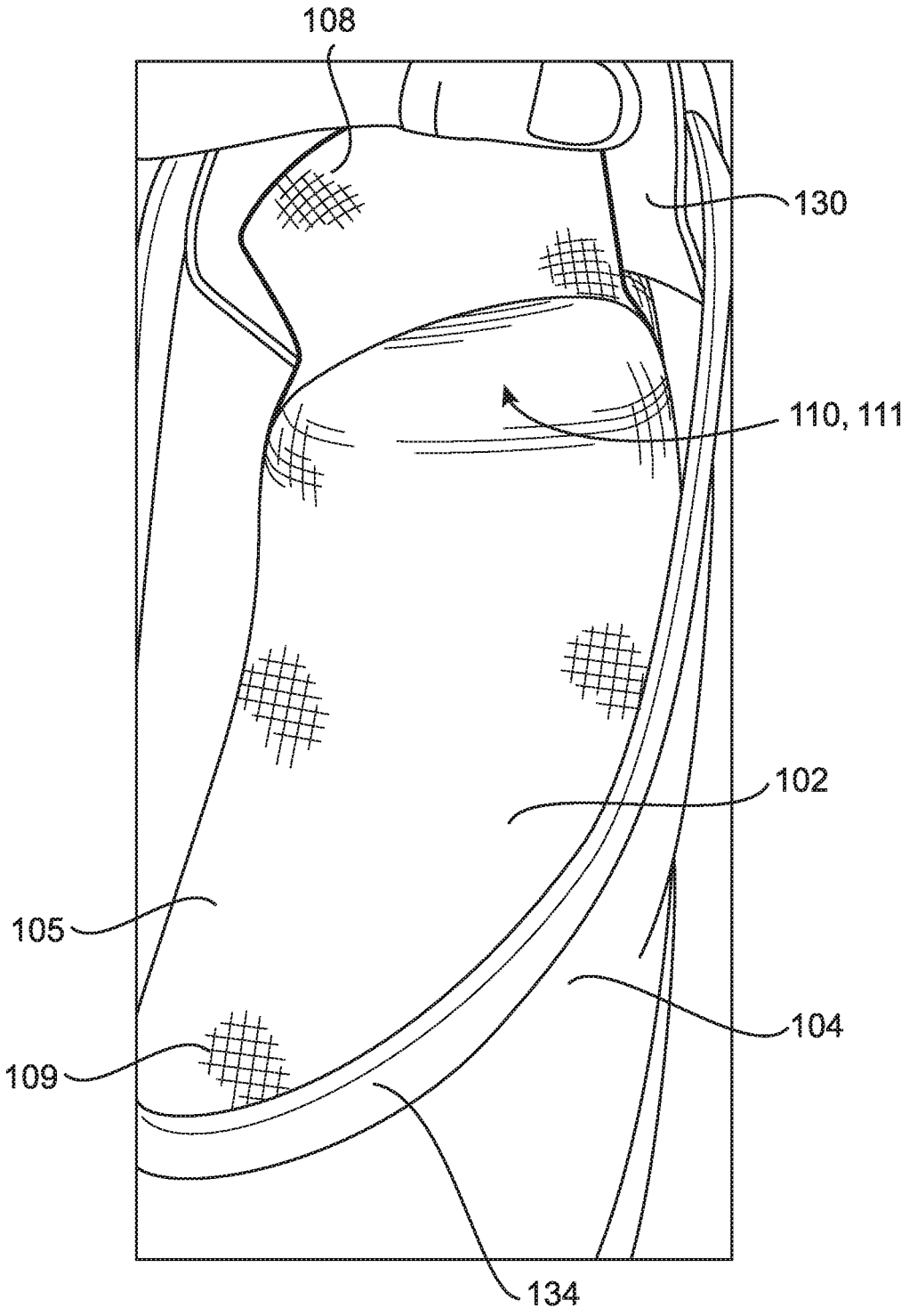
FIG. 8 is a perspective view of the shoe illustrating an interior view of the shoe with the insert liner removably coupled to the shoe, and in particular, a longitudinal portion of the insert liner removably coupled to the sole portion of the shoe; and, a front portion of the insert liner removably coupled to the tongue portion of the shoe to facilitate forming an opening of the insert liner which is configured to receive the user's foot.
Figure 9:
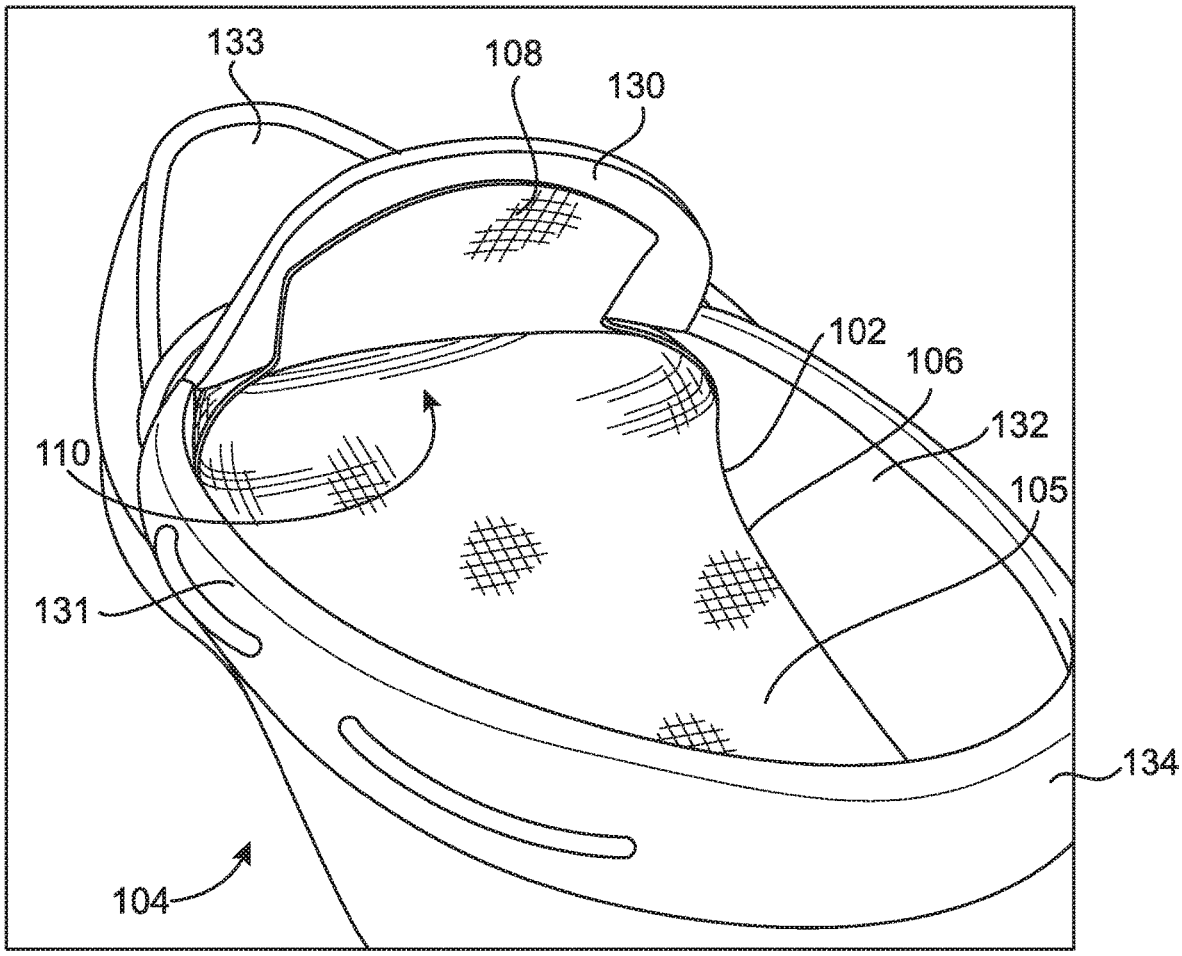
FIG. 9 is another perspective view of the shoe illustrating an interior view of the shoe with the insert liner removably coupled to the shoe, and in particular, a longitudinal portion of the insert liner removably coupled to the sole portion of the shoe; and, a front portion of the insert liner removably coupled to the tongue portion of the shoe to facilitate forming an opening of the insert liner which is configured to receive the user's foot.
Figure 10:
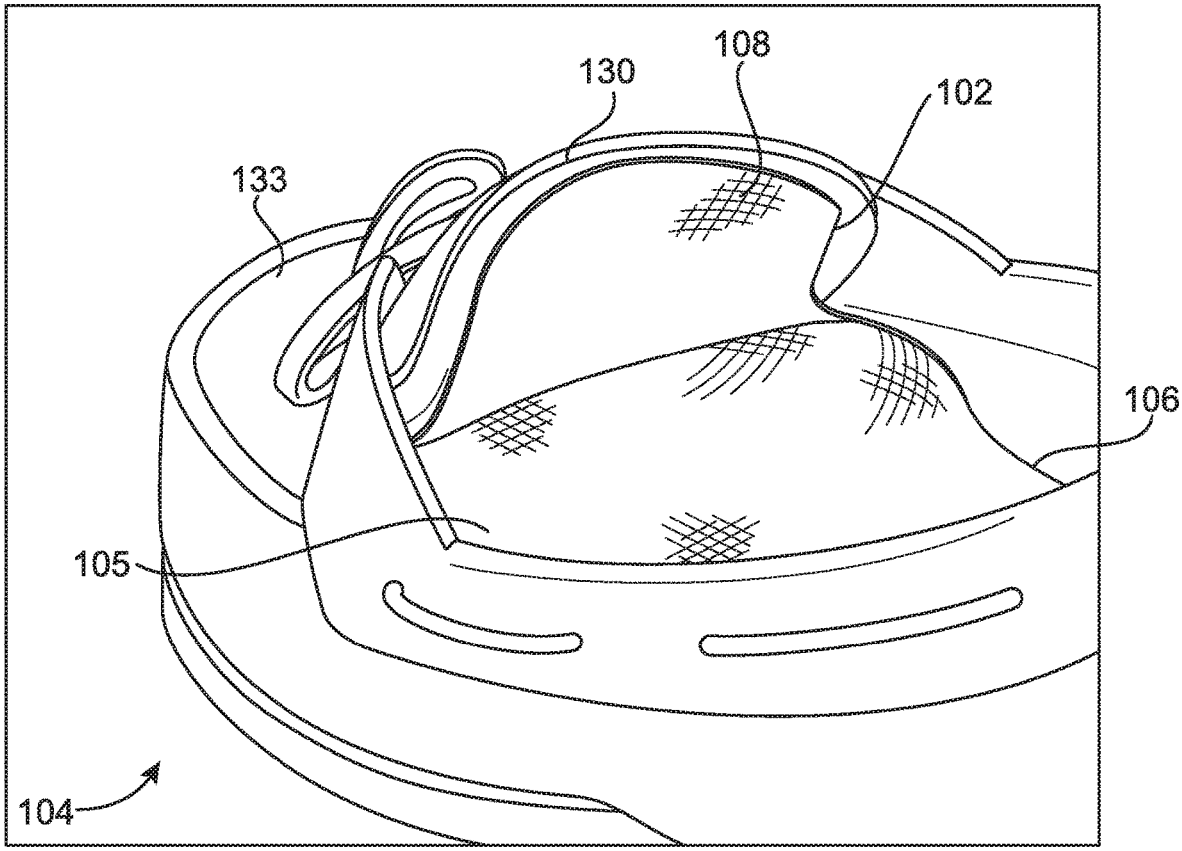
FIG. 10 is another perspective view of the shoe illustrating an interior view of the shoe with the insert liner removably coupled to the shoe, and in particular, a longitudinal portion of the insert liner removably coupled to the sole portion of the shoe; and, a front portion of the insert liner removably coupled to the tongue portion of the shoe.

FIG. 8 is a perspective view of the shoe 104 illustrating an interior view of the shoe 104 with the insert liner 100 removably coupled to the shoe 104, and in particular, the longitudinal portion 105 of the insert liner 100 removably coupled to the sole portion 135 of the shoe 104; and, the front portion 108 of the insert liner 100 removably coupled to the tongue portion 130 of the shoe 104 to facilitate forming the opening 111 of the insert liner 100 which is configured to receive the user's foot. FIG. 9 is another perspective view of the shoe 104 illustrating an interior view of the shoe 104 with the insert liner 100 removably coupled to the shoe 104, and in particular, the longitudinal portion 105 of the insert liner 100 removably coupled to the sole portion 135 of the shoe 104; and, the front portion 108 of the insert liner 100 removably coupled to the tongue portion 130 of the shoe 104 to facilitate forming the opening 111 of the insert liner 100 which is configured to receive the user's foot. FIG. 10 is another perspective view of the shoe 104 illustrating an interior view of the shoe 104 with the insert liner 100 removably coupled to the shoe 104, and in particular, the longitudinal portion 105 of the insert liner 100 removably coupled to the sole portion 135 of the shoe 104; and, the front portion 108 of the insert liner 100 removably coupled to the tongue portion 130 of the shoe 104 to facilitate forming the opening 111 of the insert liner 100 which is configured to receive the user's foot.

Figure 11:
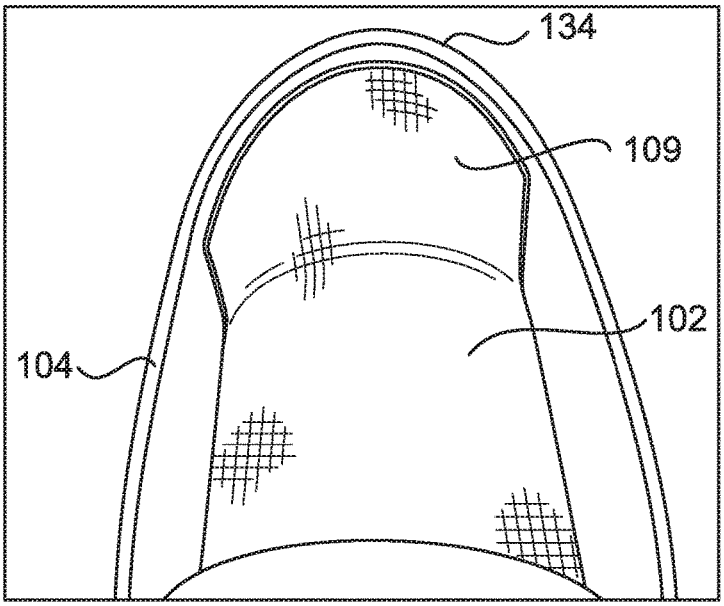
FIG. 11 is another perspective view of the shoe illustrating an interior view of the shoe with the insert liner removably coupled to the shoe, and in particular, the longitudinal portion of the insert liner removably coupled to the sole portion of the shoe, and a rear portion of the insert liner removably coupled to the heel portion of the shoe.
Figure 12:
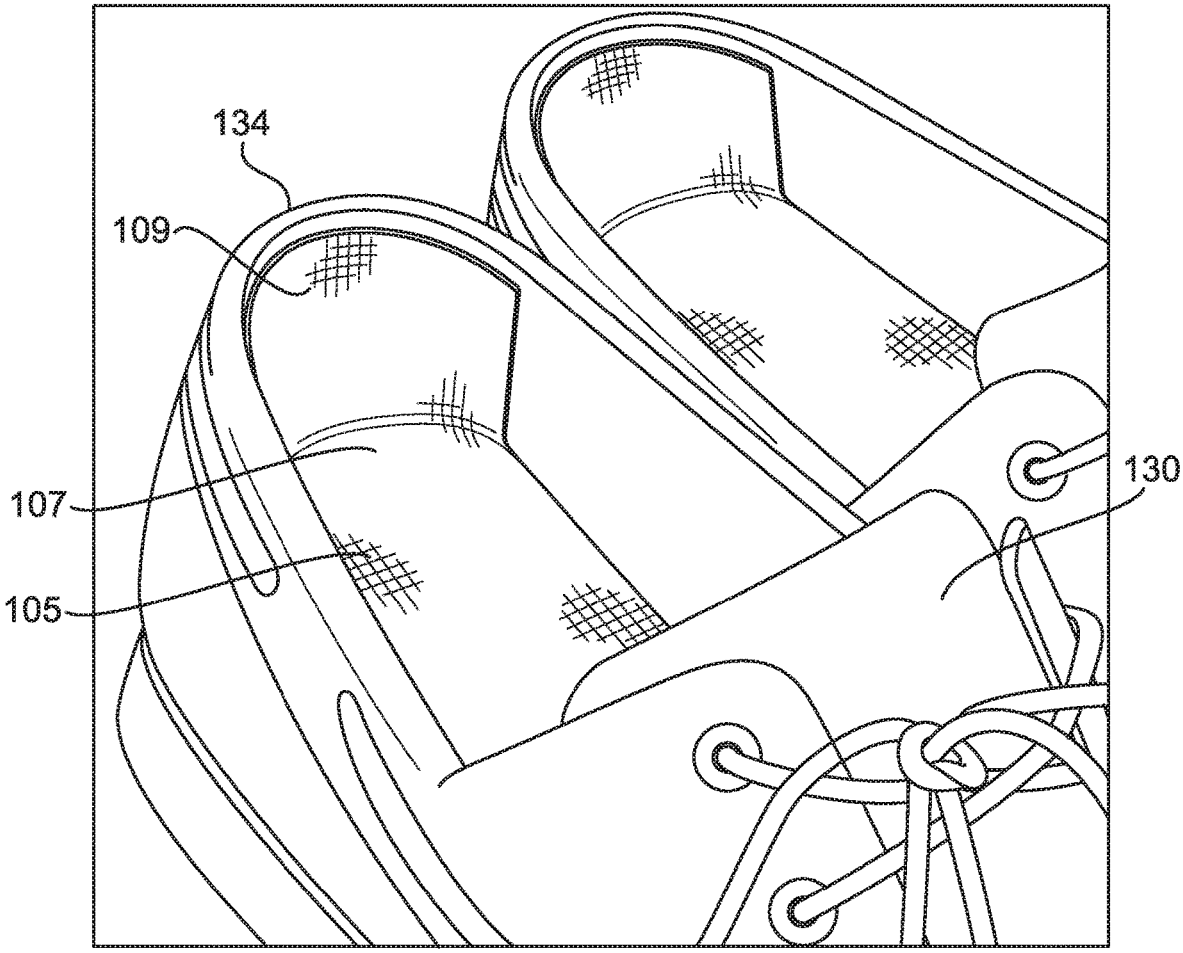
FIG. 12 is another perspective view of the shoe illustrating an interior view of the shoe with the insert liner removably coupled to the shoe, and in particular, the longitudinal portion of the insert liner removably coupled to the sole portion of the shoe, and a rear portion of the insert liner removably coupled to the heel portion of the shoe.

FIG. 11 is another perspective view of the shoe 104 illustrating an interior view of the shoe 104 with the insert liner 100 removably coupled to the shoe 104, and in particular, the longitudinal portion 105 of the insert liner 100 removably coupled to the sole portion 135 of the shoe 104, and the rear portion 109 of the insert liner 100 removably coupled to the heel portion 134 of the shoe 104 to facilitate creating the opening 111 of the insert liner 100 which is configured to receive the user's foot. FIG. 12 is another perspective view of the shoe 104 illustrating an interior view of the shoe 104 with the insert liner 100 removably coupled to the shoe 104, and in particular, the longitudinal portion 105 of the insert liner 100 removably coupled to the sole portion 135 of the shoe 104, and the rear portion 109 of the insert liner 100 removably coupled to the heel portion 134 of the shoe 104 to facilitate creating the opening 111 of the insert liner 100 which is configured to receive the user's foot.

Figure 13:
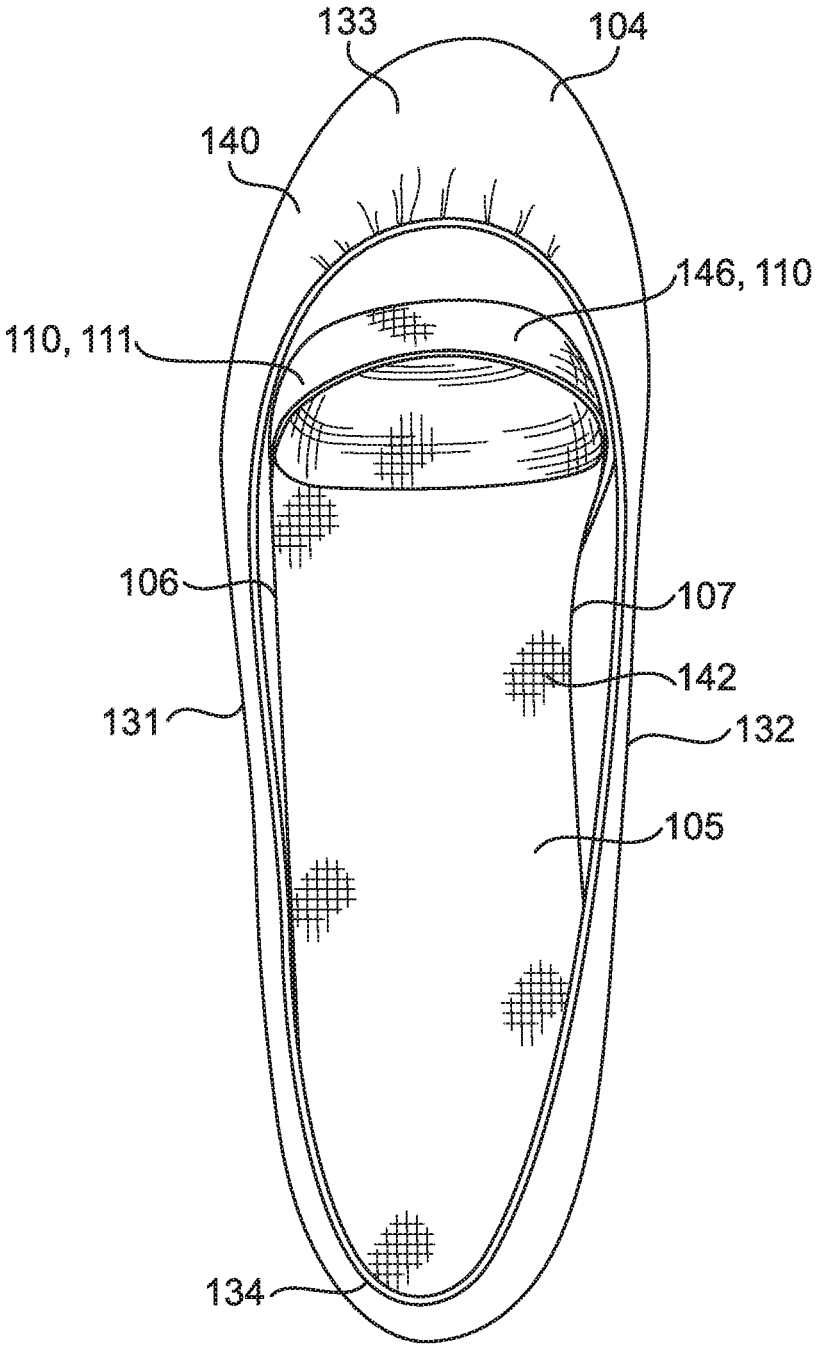
FIG. 13 is a perspective and interior view of the another shoe and another exemplary insert liner removably coupled to the shoe, and in particular, a longitudinal portion of the insert liner removably coupled to the sole portion of the shoe and a rear portion of the insert liner removably coupled to the heel portion of the shoe, wherein the insert liner includes a retainer that is configured to facilitate creating the opening of the insert liner which is configured to receive the user's foot.
Figure 14:
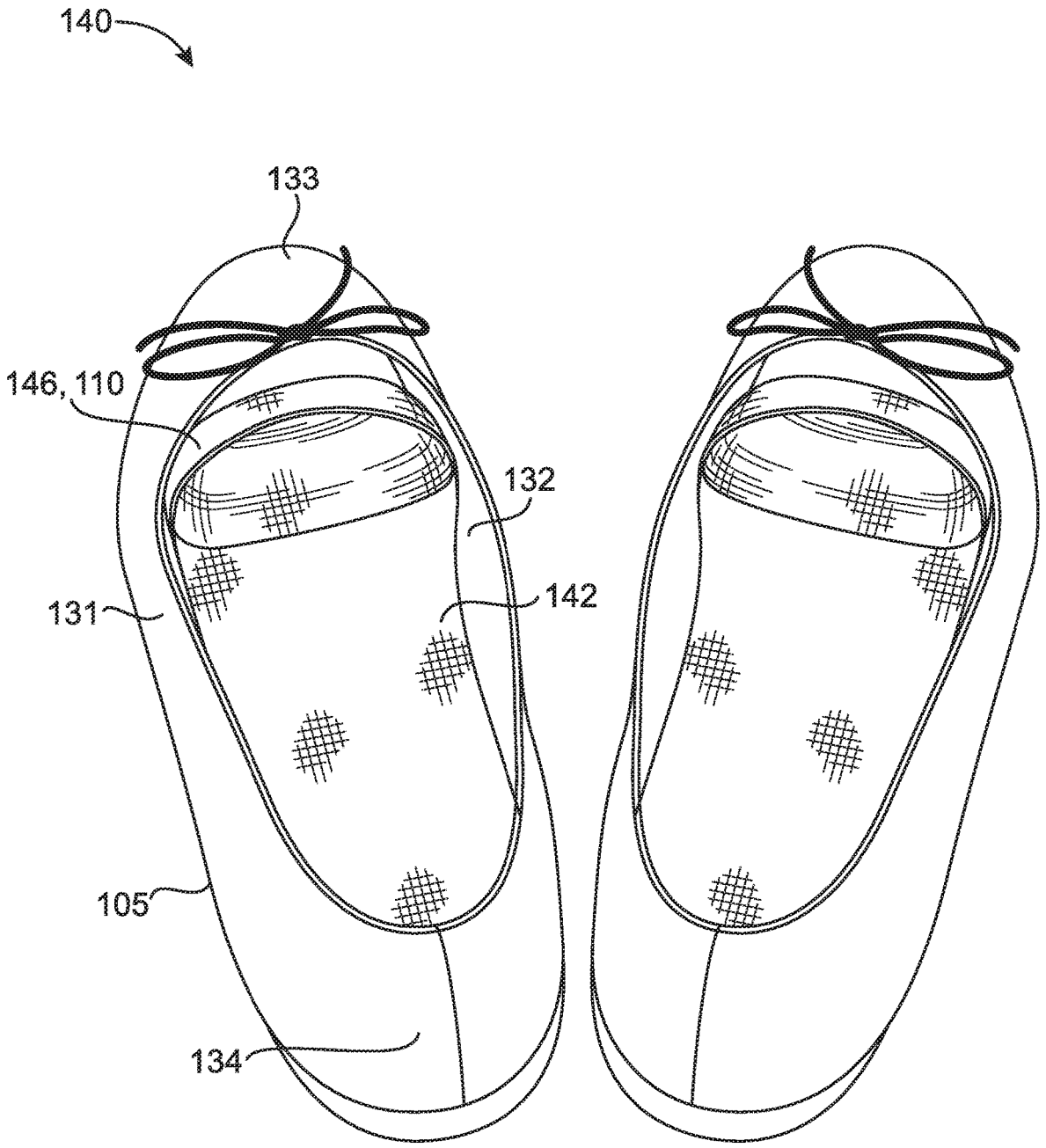
FIG. 14 is a perspective and interior view of a pair shoes and the insert liner of FIG. 13 removably coupled to the shoes.
Figure 15:
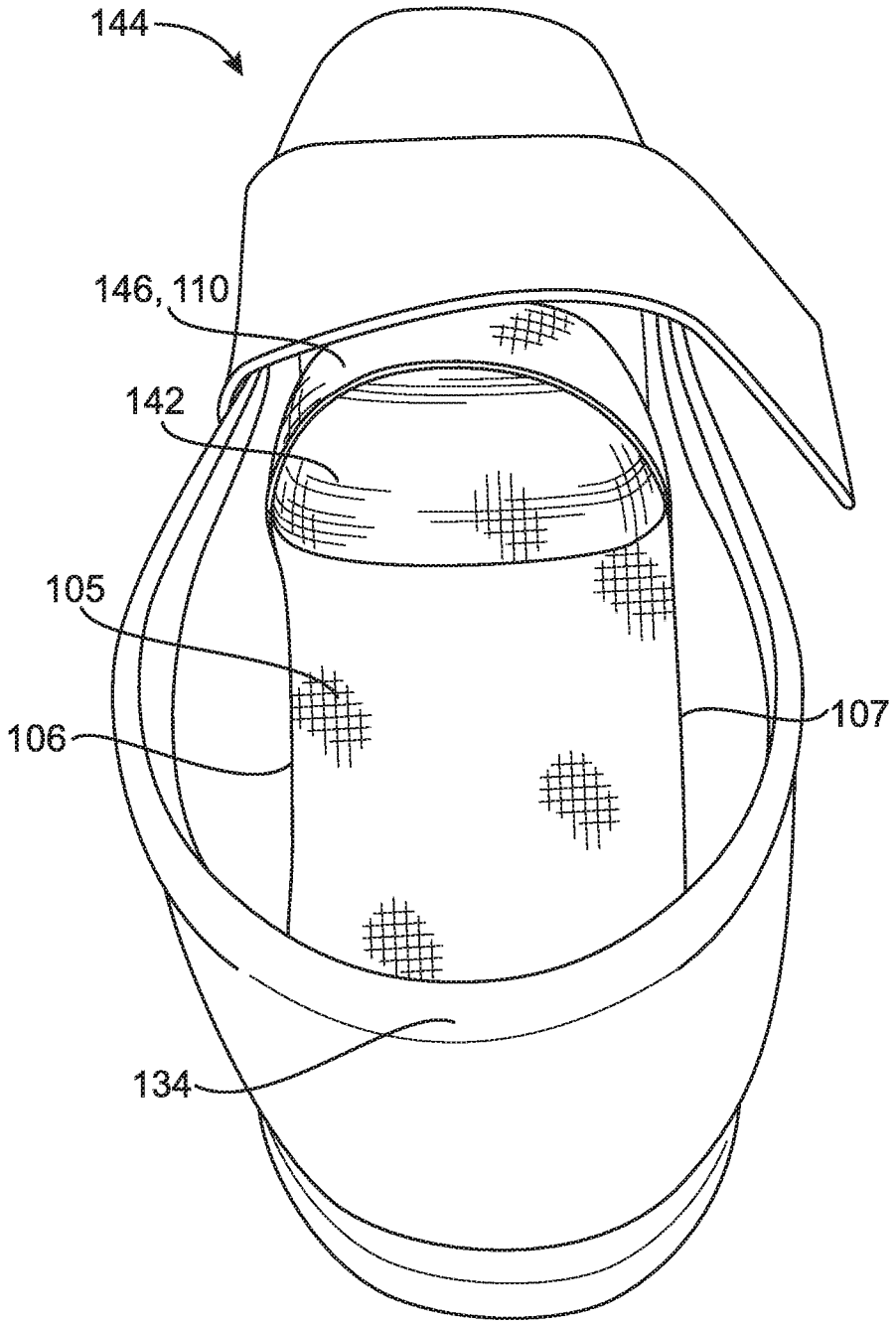
FIG. 15 is a perspective and interior view of another type of shoe and the insert liner of FIG. 13 removably coupled thereto.

FIG. 13 is a perspective and interior view of another shoe 140 and another insert liner 142 removably coupled to a shoe 140. FIG. 14 is a perspective and interior view of a pair of shoes 140 and the insert liner 142 of FIG. 13 removably coupled to the shoes 140. FIG. 15 is a perspective and interior view of another shoe 144 and the insert liner 142 removably coupled thereto. In FIGS. 13-15, similar components shown in FIGS. 1-12 include similar elements numbers shown in FIGS. 1-12. The insert liner 142 includes the fastener 102 with respective hooks 136 and loops 138 as previously described herein. In the exemplary embodiment of FIGS. 13-14, the insert liner 142 does not include the tongue portion and/or has a smaller tongue portion and is used in shoe 140 that often does not include a tongue or has limited tongue, such as, but not limited to, women's flats, pumps, and ballet type shoes 140. In the exemplary embodiment of FIG. 15, the insert liner 142 does not include the tongue portion and/or has a smaller tongue portion and is used in shoe 144 that often does not include a tongue or has limited tongue, such as, but not limited to, children shoes 144. Accordingly, no portion of the front portion 108 of the insert liner 142 includes the hook and loop fastener 102. In the embodiments, the hook 136 can be free from coupling to the front portion 108 of the insert liner 142 such as, for example, a tongue portion of the insert liner 142. In other words, the hook 136 is not positioned on the front portion 108 such as, for example, the tongue portion of the insert liner 142.

As illustrated, the front portion 108 of the insert liner 142 is spaced away from and separated from the shoes 140, 144. In this embodiment, the insert liner 142 includes a retainer 146 such as, for example only, an ultra-strong spandex or Lycra type yarn is knitted, embedded, and/or coupled to the fabric layer 101. The retainer 146 is configured to create the opening 111 to receive the user's foot. The retainer 146 is also configured to maintain or keep at least one of the longitudinal portion 105, the lateral portions 106, 107, and the front portion 108 of the insert liner 142 firmly wrapped around the user's toes much like a typical sock. Since the front portion 108 of the insert liner 142 is not coupled or attached to the shoes 140, 144, the retainer 146 is configured to provide a rigid or semi-rigid structure to facilitate forming the opening 111. Additionally, the retainer 146 is configured to keep the opening 111 in a circular shape to accept the user's foot and keep the toe portion of the insert liner 142 from sliding forward while the user is walking around or otherwise using the shoes 140, 144.

As previously described, the hook 136 is selectively positioned and coupled to at least one of the longitudinal portion 105, the lateral portions 106, 107, and rear portion 109 of the insert liner 142. Moreover, the loop 138 is selectively positioned and coupled to at least one of the opposing sidewall portions 131, 132, the heal portion 134, and the insole portion 135 of shoes 140, 144. Alternatively, the hook 136 can be selectively positioned and coupled to the front portion 108 of the insert liner 142 and the loop 138 can be selectively positioned and coupled to the forward portion 133 of the shoes 140, 144.

It will be appreciated that in the embodiment in which the front portion 108 of the insert liner 142 is not configured to fasten to the tongue portion 133 of the shoes 140, 144, the user needs to apply pressure only to at least one of the rear portion 109, the longitudinal portion 105, the lateral portions 106, 107, and a portion of the front portion 108 of the insert liner 142 100, such that the insert liner 142 100 is fastened to at least one of the heel portion 134, the insole/bottom portion 135, the sidewall portions 131, 132, of the interior cavity 103 of the shoes 140, 144.

Accordingly, the retainer 146 is configured to form and maintain the opening 111 in the insert liner 142 such that the user's bare foot may be readily inserted into the cavity 110 of the insert liner 142. Furthermore, the fastening bond between the hook 136 fused to the insert liner 142 and the loop 138 adhered to shoes 140, 144 and the structure of the retainer 146 provides a counter-pulling force as the user's foot is inserted into the cavity 110 in the insert liner 142, thereby allowing the front portion 108 of the insert liner 142 100 to be stretched snuggly around the user's foot (for example, the insert liner 142 is configured to remain fastened to the shoes 140, 144 as the user's foot is inserted into the cavity 110 of the shoe 104 such that the front portion 108 of the insert liner 142 100 may stretch toward the toe portion 133 of the shoe 104 and thereby conform to a portion of the user's foot).

In other words, the fastener 102 is coupled or bonded to at least the lateral portion 105, and the rear portion 109 of the insert liner 142 while being bond free relative to the toe portion of the insert liner 142, The rear portion 109 is configured to releasably adhere to the heel portion 134, the longitudinal portion 105 is configured to releasably adhere to the insole portion 135, and the retainer 146 is configured to form the opening 111 to maintain the opening 111 below an upper edge 126 of at least one of the heel portion 134 and the opposing sidewall portions 131, 132 and to define the cavity 110 configured to receive the user's foot. The fastener 102 and the retainer 146 facilitate a counter-pulling force as the user's foot is inserted into the cavity 110. The fabric layer 101 of the insert layer 142 is configured to stretch around the user's foot to expand the wicking material and the antimicrobial material of the yarns of the fabric layer 101.

In the exemplary embodiments, a method includes manufacturing the insert liner 100. The method includes a task of unfurling fabric sheets from a spool and feeding the fabric sheets through a fastener machine. The fastener machine applies the fastener, such as a hook and loop fastener, to one side of the fabric layer 101. The machine can also apply adhesives and/or magnetic yarns into and/or onto the fabric liner 1001. In one embodiment, the opposite side of the fabric layer 101 is not coated such that one side of the fabric layer 101 remains exposed. In one embodiment, fabricating the insert liner 100 includes knitting the fabric layer on a knitting machine and then fusing (via a hot melt adhesive), gluing, ultrasonically welding or sewing the hook portion of a hook and loop fastener onto the outside of the insert liner. As described above, exposing one side of the fabric layer 101 promotes wicking moisture away from the user's foot during use of the shoe insert liner 100. In one embodiment, the fastener 102 covers substantially all of one side of the fabric layer 101 (i.e., the fastener 102 may be substantially coextensive with the fabric layer 101). In an alternate embodiment, the fastener 102 may be applied only to localized regions of one side of the fabric layer 101. In one embodiment, the fastener 102 is applied only to the rear portion 109, the longitudinal portion 105, the lateral portions 106, 107, and a portion of the front portion 108 of the shoe insert liner 100 that corresponds to the tongue portion 130 of the shoe 104, as illustrated in FIGS. 2A and 2B. Providing no fastener 102 along the portion of the shoe insert liner 100 that corresponds to the toe portion 133 of the shoe 104 tends to conform this portion of the shoe insert liner 100 to the user's foot, as illustrated in FIG. 3B, which tends to aid in wicking moisture from the user's foot.

The amount and location of the fastener 102 applied may depend upon the desired strength of the bond between the shoe insert liner 100 and the shoe 104. In one embodiment, the fabric sheet is approximately 12 inches wide, although the fabric sheet may be narrower or wider depending upon the size of the shoe 104 for which the shoe insert liner 100 is intended to be used. The method of manufacturing the shoe insert liner 100 also comprises a task of curing the fastener 102 formed on one side of the fabric layer 101. In one embodiment, a curing machine is configured to supply a heat source which cures the fastener 102 to the fabric layer 101. In one embodiment, the method of manufacturing the shoe insert liner 100 also includes a task of applying a protective covering, such as a thin film, to cover the adhesive layer 102. The protective covering is configured to prevent contamination of the fastener 102 during the remaining manufacturing processes and during packaging and shipping. Moreover, the protective covering is configured to be removed from the fastener 102 prior to insertion of the shoe insert liner 100 into the interior cavity 103 of the shoe 104.

The method of manufacturing the shoe insert liner 100 may include a task of cutting the fabric sheet 101 having a fastener 102 into a flat pattern with a cutting mechanism. The cutting mechanism may be any machine suitable for cutting fabric, such as a die cutting machine or a laser cutting machine. The flat pattern 122 has portions corresponding to the front portion 108, the opposing lateral portions 106, 107, the longitudinal portion 105, and the rear portion 109 of the finished shoe inserts liner 100. In one embodiment, the method comprises a task of connecting seam portions, such as by stitching or bonding, to form the shoe insert liner 100. Specifically, opposing edges of the flat pattern 122 are configured to be connected together to form the lateral portions 106, 107 of the shoe insert liner 100. Other edges are configured to be connected together to form the rear portion 109 of the shoe insert liner 100. Other edges are configured to be connected together to faun the front portion 108 of the shoe insert liner 100. It will be appreciated by a person of ordinary skill in the art that the edges of the flat pattern 122 must be folded in the same direction to produce the cavity 110 of the shoe insert liner 100 configured to receive the user's foot. Moreover, the edges of the flat pattern 122 must be folded such that the fastener 102 is disposed on the exterior surface of the shoe insert liner 100. That is, the edges of the flat pattern 122 must be folded away from the fastener 102.

The embodiments described herein are directed to an insert liner for a shoe, and more particularly to a detachable insert liner and a method of manufacturing the same. The insert liner is configured to detachably adhere to the interior cavity of the shoe with the application of positive pressure, using a hook and loop fastener, or other fastening methods including, but not limited to, adhesives or magnetic yarns that are knit into the sock. The hook or other fastening means is permanently fused onto the outside of the insert liner and the loop or other receiving means is adhered, for example via a pressure sensitive adhesive, to the interior lining of a shoe. The hook and loop are in congruent pieces such that the positive pressure of the hook and loop semi permanently attaches the insert liner to the interior of a shoe in the "no show" or "no look" position. The insert liner is configured to generally conform to the contour of at least a portion of the interior cavity of the shoe. The insert liner is secured to at least a portion of the interior cavity of the shoe with a temporary bond of the hook and loop, such that the user may detach the insert liner from the shoe as desired. Moreover, the insert liner may be removed from the interior cavity of the shoe and subsequently re-inserted without the need to apply any additional materials to the insert liner, simply the reapplication of the insert liner and the positive pressure of the hook and loop fastener reapplies the insert liner to the shoe. Additionally, the adhesive insert liner is machine-washable such that the insert liner retains fastening properties, wicking properties, and antimicrobial properties after washing.

The insert liner may also be configured to be completely recessed in the interior cavity of the shoe such that the insert liner does not extend above a collar portion of the shoe, which tends to conceal the insert liner from view by other individuals. In one embodiment, the insert liner is configured to wick moisture away from the user's foot. In a further embodiment, the insert liner may be comprised of an antimicrobial material. The antimicrobial material is configured to keep the insert liner fresh after every wearing, via killing, for example, up to 99.9% of odor causing bacteria, specifically the foot odor bacteria *Staphylococcus aureus, Klebsiella pneumoniae*, Brevibacteria, Propionibacteria, *Staphylococcus epidermidis* or other bacteria or funguses. The shoe insert liner may be provided in various shapes and sizes such that the insert liner is configured for use with a variety of different shoes, such as, for example only, loafers, dress shoes, boots, oxford shoes, women's flats, high heels, sneakers, casual walking shoes, and gym shoes.

While the embodiments have been described in detail with particular references to exemplary embodiments thereof, the exemplary embodiments described herein are not intended to be exhaustive or to limit the scope of the invention to the exact forms disclosed. Persons skilled in the art and technology to which this invention pertains will appreciate that alterations and changes in the described structures and methods of assembly and operation can be practiced without meaningfully departing from the principles, spirit, and scope of this invention, as set forth in the following claims. Although relative terms such as "side", "longitudinal", "lateral", "front", "rear", "forward", "bottom", "outer," "inner," "upper," "lower," "below," "above," "vertical," "horizontal" and similar terms have been used herein to describe a spatial relationship of one element to another, it is understood that these terms are intended to encompass different orientations of the various elements and components of the device in addition to the orientation depicted in the figures. Moreover, the figures contained in this application are not necessarily drawn to scale.

Exemplary embodiments of an insert liner are described herein. The methods and assemblies are not limited to the specific embodiments described herein, but rather, components of assemblies and/or steps of the methods may be utilized independently and separately from other components and/or steps described herein. For example, the methods may also be used in combination with other assemblies and methods, and are not limited to practice with only the assemblies and methods described herein. Rather, the exemplary embodiments may be implemented and utilized in connection with many other footwear or clothing types.

Although specific features of various embodiments of the invention may be shown in some drawings and not in others, this is for convenience only. In accordance with the principles of the invention, any feature of a drawing may be referenced and/or claimed in combination with any feature of any other drawing.

This written description uses examples to disclose the invention and also to enable any person skilled in the art to practice the invention, including making and using devices or assemblies or systems and performing any incorporated method. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. An insert liner configured to be received in an inner cavity of a shoe having a heel portion, a toe portion, an upper portion, an insole portion, and opposing sidewall portions, the insert liner comprising:

an elastomeric layer comprising a wicking material and an antimicrobial material embedded within the elastomeric layer, the elastomeric layer comprising:

a longitudinal portion;

a front portion at a front end of the longitudinal portion, the front portion including opposing lateral sections extending generally upwardly from opposite sides of the longitudinal portion, a lower section extending between the opposing lateral sections, and a toe section; and a rear portion at a rear end of the longitudinal portion, wherein the rear portion is extendable generally upwardly from the rear end of the longitudinal portion;

a fastener layer comprising a plurality of fasteners coupled to an outer surface of the elastomeric layer at least at the longitudinal portion, the lower section of the front portion, and the rear portion of the elastomeric layer while being fastener free at the toe section of the front portion, the plurality of fasteners directly coupleable to the insole portion and the heel portion of the shoe such that the fastener layer is configured to keep the elastomeric layer below an upper edge of at least one of the heel portion and the opposing sidewall portions of the shoe as a user's foot is removed from the inner cavity of the shoe and enable the longitudinal portion and the lower section of the front portion to provide a lower counter-pulling force as the user's foot is inserted into the inner cavity of the shoe while the toe section of the front portion is stretched around the user's foot to expand the wicking material and the antimicrobial material of the elastomeric layer; and a retainer coupled to the front portion of the elastomeric layer, the retainer defining an opening and configured to keep the opening in a circular shape, the retainer removably coupleable to the upper portion of the shoe such that the retainer is configured to provide an upper counter-pulling force as the user's foot is inserted into the inner cavity of the shoe.

2. The insert liner of claim 1 wherein the plurality of fasteners comprise a hook and loop fastener.

3. The insert liner of claim 2 wherein the hook and loop fastener comprises a hook coupled to the elastomeric layer and a loop coupled to the shoe.

4. The insert liner of claim 3 wherein the hook is securely coupled to the elastomeric layer and the loop is removably coupled to the shoe.

5. The insert liner of claim 3 wherein the hook is coupled to the elastomeric layer by at least one of a fused, sewn, adhered, glued, or ultrasonically welded attachment on to at least a portion of the exterior surface of the elastomeric layer, allowing the elastomeric layer to remain in place as the user slips in and out of the shoe barefoot.

6. The insert liner of claim 3 wherein the hook comprises an ultra-thin hook fused onto at the exterior surface of the elastomeric layer by at least one of gluing, a hot melt adhesive, sewing, or ultrasonically welding process.

7. The insert liner of claim 3 wherein the hook is washable and reusable.

8. The insert liner of claim 1 wherein the plurality of fasteners are washable and reusable.

9. The insert liner of claim 1 wherein the plurality of fasteners comprise a male hook fused or sewn to the exterior surface of the elastomeric layer and is paired with congruent pieces of loop or other knit, woven or non-woven fabric material with a texture configured to receive the male hook, the congruent pieces of loop or other knit, woven or non-woven fabric material adhered to an interior surface of the shoe using a pressure sensitive adhesive.

10. The insert liner of claim 1 wherein the plurality of fasteners comprise first magnetic yarns in certain portions or pieces of the exterior surface of the elastomeric layer, paired with second magnetic yarns in congruent pieces of loop or other knit, woven or non-woven fabric material at an interior surface of the shoe using a pressure sensitive adhesive.

11. The insert liner of claim 1, wherein none of the plurality of fasteners are directly coupled to the toe section of the front portion of the elastomeric layer such that the toe section is free to wrap around the user's foot and give the feeling of wearing a typical thin sock.

12. The insert liner of claim 1 wherein from approximately 5 percent to approximately 100 percent of the elastomeric layer comprises the antimicrobial material.

13. The insert liner of claim 1 wherein when the elastomeric layer is releasably coupled to an interior surface of the shoe, the elastomeric layer extends below a collar portion of the shoe.

14. The insert liner of claim 1 wherein the toe section of the front portion of the elastomeric layer is free from the adhesive layer.

15. The insert liner of claim 1 wherein the elastomeric layer is not releasably coupleable to the toe portion of the shoe such that the toe section of the front portion of the elastomeric layer is configured to stretch forward toward the toe portion of the shoe when the user's foot is inserted through a cavity defined by the front portion of the elastomeric layer.

16. An insert liner configured to be received in an inner cavity of a shoe having a heel portion, a toe portion, an upper portion, an insole portion, and opposing sidewall portions, the insert liner comprising:

an elastomeric layer comprising a wicking material and an antimicrobial material embedded within the elastomeric layer, the elastomeric layer comprising:

a longitudinal portion; and opposing front and rear portions extendable generally upwardly from opposite ends of the longitudinal portion, wherein the front portion includes a lower section and a toe section defining a liner cavity;

a retainer coupled to the front portion, wherein the retainer provides structural support to the front portion such that the front portion defines an opening configured to receive a user's foot and firmly wrap around the user's foot when the user's foot is received in the liner cavity through the opening, the retainer removably coupleable to the upper portion of the shoe such that the retainer is configured to provide a counter-pulling force as the user's foot is received in the liner cavity; and a fastener layer comprising one or more fasteners coupled to at least the longitudinal portion, the lower section of the front portion, and the rear portion of the elastomeric layer while being fastener free at the toe section of the front portion, wherein, when the rear portion is releasably coupled to the heel portion of the shoe, and the longitudinal portion and the lower section of the front portion are releasably coupled to the insole portion of the shoe, the insert liner remains in the inner cavity of the shoe and is maintained below an upper edge of at least one of the heel portion and the opposing sidewall portions of the shoe as the user's foot is withdrawn from the liner cavity, and the wicking material and the antimicrobial material expand when the elastomeric layer stretches around the user's foot as the user's foot is received in the liner cavity.

17. The insert liner of claim 16 wherein the front portion of the elastomeric layer is separated and spaced away from the tongue portion of the shoe.

18. The insert liner of claim 16 wherein the retainer comprises a polyether-polyurea copolymer material.

19. An elastomeric insert liner configured to be received in an inner cavity of a shoe, the elastomeric insert liner comprising:

a longitudinal portion;

a front portion at a front end of the longitudinal portion, the front portion including a toe section defining a liner cavity;

a rear portion at a rear end of the longitudinal portion, the rear portion extendable generally upwardly from the rear end of the longitudinal portion, wherein the longitudinal portion, the front portion, and the rear portion are comprised of a wicking material and an antimicrobial material embedded within the elastomeric layer and define a space sized to receive a user's foot;

a retainer coupled to the front portion, the retainer defining an opening and configured to keep the opening in a circular shape, the retainer removably coupleable to an upper portion of the shoe such that the retainer is configured to provide a counter-pulling force as the user's foot is inserted into the space; and a plurality of fasteners including a first fastener coupled to the longitudinal portion and a second fastener coupled to the rear portion, wherein, when the plurality of fasteners are coupled to an inner surface of the shoe defining the inner cavity while being fastener free at the toe section of the front portion, the plurality of fasteners keep the longitudinal portion, the front portion, and the rear portion in the inner cavity of the shoe as a user's foot is inserted into the space and as the user's foot is removed from the space.

* * * * *